US005240319A

United States Patent [19]

Koga

[11] Patent Number: 5,240,319

[45] Date of Patent: Aug. 31, 1993

[54] UPPER BODY OPENING/CLOSING MECHANISM FOR ELECTRONIC EQUIPMENT

[75] Inventor: Yuji Koga, Nagoya, Japan

[73] Assignee: Brother Kogyo Kabushiki Kaisha, Nagoya, Japan

[21] Appl. No.: 718,656

[22] Filed: Jun. 21, 1991

[30] Foreign Application Priority Data

Aug. 22, 1990 [JP] Japan ..... 2-221849

[51] Int. Cl.[5] ..... A47B 95/00

[52] U.S. Cl. ..... 312/319.2; 16/306; 16/308; 220/264; 220/335

[58] Field of Search ..... 312/319.2, 319.4, 327, 312/328; 16/280, 285, 289, 306, 308; 220/264, 335

[56] References Cited

U.S. PATENT DOCUMENTS

| | | | |
|---|---|---|---|
| 3,166,080 | 1/1965 | Neale | 220/335 X |
| 4,193,164 | 3/1980 | Okayama | 220/335 X |
| 4,616,765 | 10/1986 | Katoh | 220/335 |
| 4,856,142 | 8/1989 | Fukunaga | 220/335 X |
| 5,028,913 | 7/1991 | Kitamura | 16/306 X |

FOREIGN PATENT DOCUMENTS 2-744 1/1990 Japan .

*Primary Examiner*—Kenneth J. Dorner
*Assistant Examiner*—Brian K. Green
*Attorney, Agent, or Firm*—Oliff & Berridge

[57] ABSTRACT

An upper body opening/closing mechanism for a piece of electronic equipment that has a lower body constituting a lower portion of the piece of electronic equipment, an upper body for normally covering the upper surface of the lower body, the upper body being rotatable about one end thereof in order to expose the upper surface of the lower body, a holding member for holding the upper body at a position where the upper surface of the lower body is covered by the upper body, and an elastic member normally contacting the upper body for biasing the upper body in a direction for exposing the upper surface of the lower body by exerting an elastic force when the retained condition of the upper body maintained by the holding member is released. The elastic constant of the elastic member is set so as to balance the closing force, due to a weight of the upper body, exerted in a closing direction when the upper body is rotated up to a first predetermined angle where the weight is exerted at a center of gravity of the upper body, and the upper body opening/closing mechanism is provided with a reverse biasing member for accumulating an elastic energy thereof in a direction opposite to the opening direction of the upper body when the rotation angle of the upper body exceeds the first predetermined angle and reaches a second predetermined angle where the weight of the upper body is exerted at the center of gravity thereof in the opening direction.

9 Claims, 4 Drawing Sheets

UPPER BODY OPENING/CLOSING MECHANISM FOR ELECTRONIC EQUIPMENT

BACKGROUND OF THE INVENTION

1. Field of the Invention

The present invention relates to an upper body opening/closing mechanism for an electronic equipment such as a copying machine or a laser printer having an upper body adapted to be opened for such purposes as maintenance and inspection.

2. Description of Related Art

In known pieces of electronic equipment such as copying machines or laser printers, the upper body of the equipment is rotatable to expose an upper surface of a lower body of the equipment for purposes such as the elimination of a paper jam, i.e., a sheet of paper stopped in a paper feed path through the equipment, exchanging a toner or other maintenance. Such a conventional piece of electronic equipment has been proposed in Japanese Utility Model Publication No. 2-744, for example.

In this proposed piece of electronic equipment, the upper body is so constructed as to selectably take a first opening position where the upper surface of the lower body is exposed at a relatively small rotative angle of the upper body and a second opening position where the upper surface of the lower body is exposed almost completely. The provision of the first opening angle is for when the operator carries out the maintenance or inspection of parts disposed at a position remote from a fulcrum of rotation of the upper body, or carries out the elimination of the paper jam, the high-temperature section located in the vicinity of the fulcrum of rotation is not greatly exposed thereby ensuring the safety of the operator when carrying out the identified actions.

This conventional electronic equipment is provided with a torsion bar for biasing the upper body in the fully open direction, so as to reduce the effort required of the operator to open the upper body. A spring constant or twist of the torsion bar is so set as to rotate the upper body beyond the first opening position in the opening direction. Further, a first stopper is provided to stop the upper body at the first opening position in such a manner that when the upper body is rotated up to the first opening position, a part of the upper body contacts with the first stopper. By displacing the first stopper, the upper body can be rotated beyond the first opening position to reach the second opening position that is the fully open position A second stopper is provided at the second opening position to stop the upper body by contact therewith.

However, this prior art has a disadvantage in that the impact force generated upon contact of the upper body with the first stopper damages the equipment.

Further, at the second opening position, an impact force is similarly generated upon contact of the upper body with the second stopper. Additionally, when the upper body is rotated to the second opening position at one stroke, the operator must remove the first stopper, which makes the action troublesome. Thus, the convenience of directly rotating the upper body to the second opening position is reduced.

SUMMARY OF THE INVENTION

It is accordingly an object of the present invention to provide an upper body opening/closing mechanism for a piece of electronic equipment which can take first and second opening positions without damaging the equipment and with increased convenience to the operator.

According to the present invention, to achieve the above object, there is provided in an upper body opening/closing mechanism for a piece of electronic equipment that includes a lower body constituting a lower portion of the piece of electronic equipment, an upper body for normally covering an upper surface of the lower body, the upper body being rotatable about one end thereof in a direction where the upper surface of the lower body is exposed, a holding member for holding the upper body at a position where the upper surface of the lower body is covered by the upper body, and an elastic member normally contacting the upper body for biasing the upper body in the exposed direction of the upper surface by exerting an elastic energy itself when the holding member is released, the elastic constant of the elastic member being set to balance a closing force due to the weight of the upper body exerted in a closing direction thereof when the upper body is rotated up to a first predetermined angle where the weight is exerted at a center of gravity of the upper body in the closing direction, and the upper body opening/closing mechanism is provided with a reverse biasing member for accumulating an elastic energy thereof in a direction reverse that of an opening direction of the upper body when a rotating angle of the upper body exceeds the first predetermined angle and reaches a second predetermined angle where the weight is exerted at the center of gravity in the opening direction.

With this structure, when the rotating angle of the upper body reaches the first predetermined angle where the weight of the upper body is exerted at the center of gravity thereof in the closing direction, the rotation of the upper body in the opening direction is first stopped due to the balanced relationship between the elastic constant of the elastic member and the weight of the upper body. In this manner, the first opening position can be maintained by the force balancing relation only. The upper body can then be further rotated beyond the first predetermined angle without any additional actions, such as removing a stopper. Thereafter, when the rotating angle of the upper body reaches the second predetermined angle, where the weight of the upper body is exerted at the center of gravity in the opening direction, the elastic energy in the direction reverse to the opening direction of the upper body is accumulated by the reverse biasing member. That is, the rotation of the upper body up to the second predetermined angle is not influenced by the reverse biasing member. However, when the rotating angle of the upper body exceeds the second predetermined angle, the upper body receives a closing force from the reverse biasing member during the rotation in the opening direction contrary to the previous stage where the upper body is rotated up to the first predetermined angle and the elastic member provided a force in the opening direction.

According to the present invention, the upper body can take the first and second opening positions. When the operator intends to change the first opening position to the second opening position or vice versa, it is only necessary for him to initially move the upper body in the direction of change toward the next desired one of the opening positions, with the result that the upper body is automatically moved to the desired opening position. Accordingly, changing the opening position is greatly simplified.

Further, in the first opening position, the upper body is stopped as a result of the balanced relationship between the elastic constant of the elastic member and the weight of the upper body. Thus, unlike the prior art, using a stopper for contact stopping of the upper body, the upper body can be stopped gently according to the present invention, thereby avoiding any contact. As a result, there is no possibility of damage to the equipment.

Further, until the upper body reaches the second opening position beyond the first opening position, the closing force is applied to the upper body by the reverse biasing member. Accordingly, even when a stopper is used for stopping the upper body at the second opening position, the contact with the stopper is greatly reduced. Of course, such a stopper may be eliminated, and the upper body can be stopped at the second opening position by the balanced relationship between the weight of the upper body and the elastic constant of the elastic member.

BRIEF DESCRIPTION OF THE DRAWINGS

The present invention will be described with reference to the drawings, in which.

DESCRIPTION OF THE PREFERRED EMBODIMENT

Figure 1:
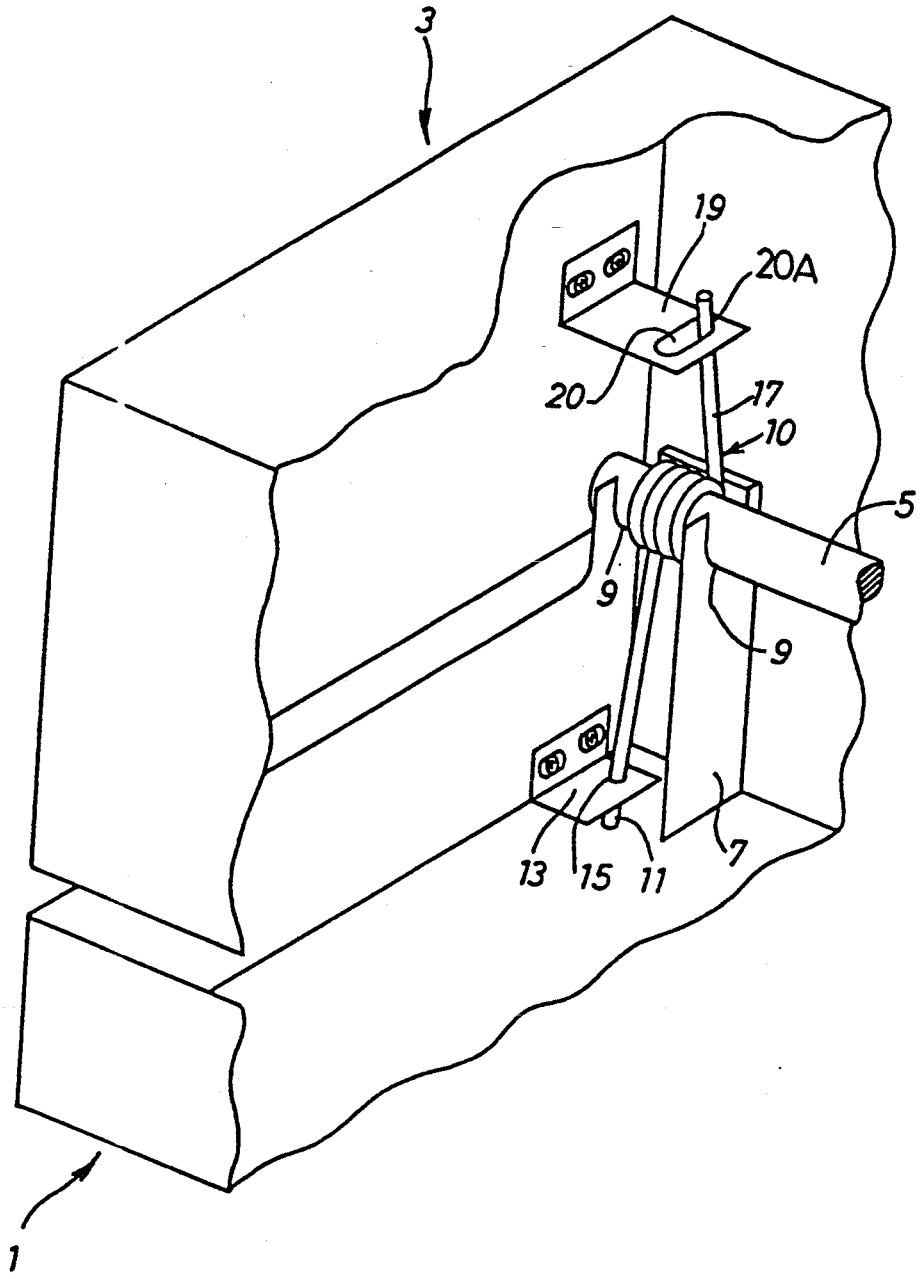
FIG. 1 is a schematic perspective view of an essential part of a preferred embodiment according to the present invention.

To make more apparent the construction and operation of the present invention mentioned above, there will now be described a preferred embodiment of a laser printer to which the upper body opening/closing mechanism of the present invention is applied, with reference to FIGS. 1 to 3.

The general function and structure of the laser printer according to the preferred embodiment are similar to those well known in the art. Therefore, the explanation of such a general function and construction will be omitted hereinafter. Further, the laser printer is only being identified as a vehicle for explaining the invention which is an opening/closing mechanism for a covering for a piece of equipment wherein two open positions are desired.

A body of the laser printer is constructed of a lower body 1 and an upper body 3. A support shaft 5 is fixed to a lower portion of the upper body 3 at one end thereof. A support member 7 having a U-shaped groove 9 is provided in the lower body 1 so that the support shaft 5 is engaged with the U-shaped groove 9 of the support member 7 and a lower surface of the support shaft 5 is supported by the U-shaped groove 9.

A torsion spring 10 is rotatably mounted on the support shaft 5. A lower straight portion of the torsion spring 10 is fixedly inserted in a hole 15 of a metal fixture 13 fixed to the lower body 1. An upper straight portion 17 of the torsion spring 10 is movably inserted in an elongated hole 20 of a metal fixture 19 fixed to the upper body 3.

Figure 2:
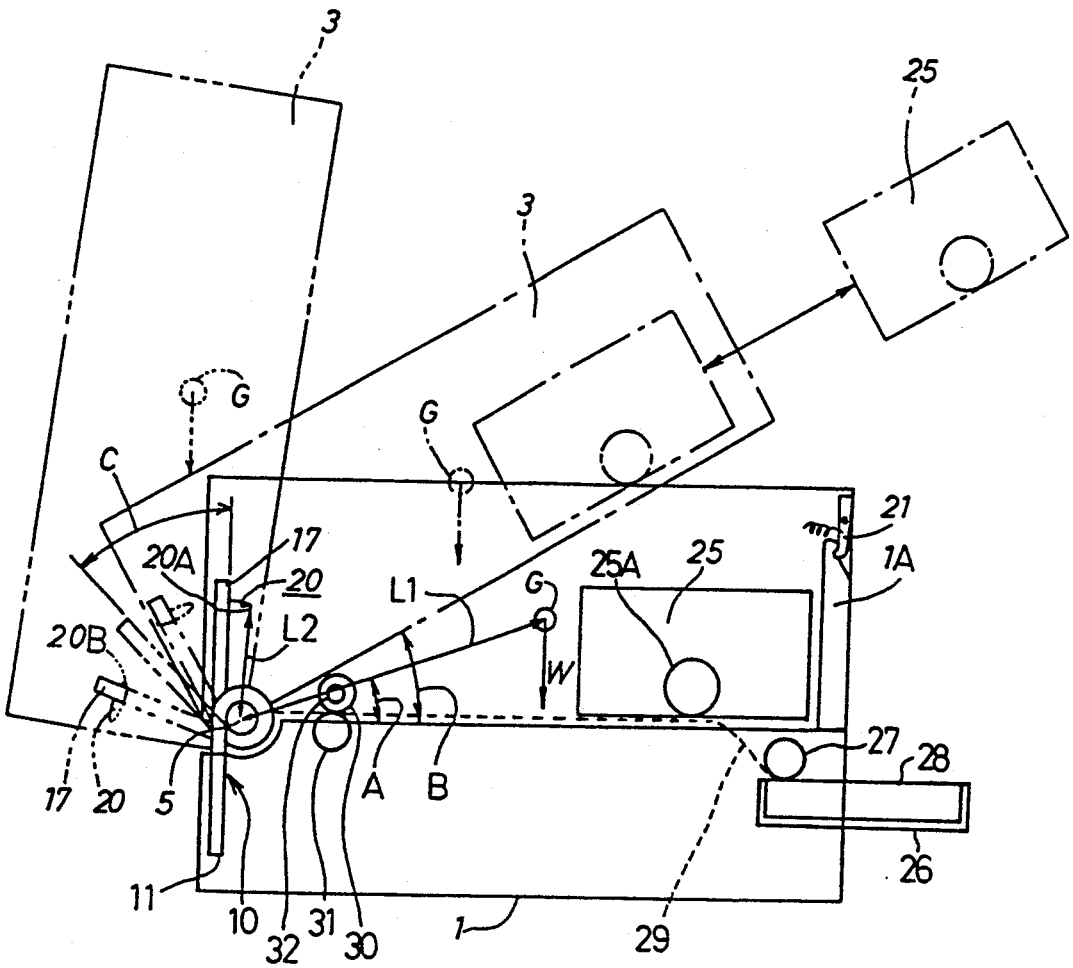
FIG. 2 is a schematic side illustration of the preferred embodiment explaining the operation of the preferred embodiment.

Referring to FIG. 2, a loaded condition of the torsion spring 10 under a full closed condition of the upper body 3 is shown by a solid line, while a natural condition of the torsion spring 10, under an open condition of the upper body 3, is shown by a one-dot chain line. Under the natural condition of the torsion spring 10, the upper straight portion 17 of the torsion spring 10 is positioned at an angle C (which will be hereinafter referred to as a natural angle C) counterclockwise from a reference position shown by the solid line in FIG. 2. Under the full closed condition of the upper body 3, the upper body 3 is locked to a front frame 1A of the lower body 1 by means of a locking member 21, and the upper straight portion 17 of the torsion spring 10 is kept in contact with a rear edge 20A of the elongated hole 20.

A balanced relationship between the weight of the upper body 3 and a spring constant of the torsion spring 10 will now be described.

Assuming that a lower surface of the upper body 3 locked in the full closed position is a reference position, a center of gravity G of the upper body 3 is positioned at an initial angle A from the reference position in the opening direction of the upper body 3. Letting L1 denote a distance from the support shaft 5 to the center of gravity G and W denote a weight of the upper body 3, a rotation moment M1 (which will be hereinafter referred to as a body moment M1) due to the weight W of the upper body 3 at a rotational angle B (which will be hereinafter referred to as an opening angle B) of the upper body 3 from the reference position is expressed as follows:

$$M1 = W \cdot L1 \cdot \mathrm{COS}(A+B \tag{1}$$

As is apparent from the equation (1), the condition for making the body moment M1 become zero (0 kg-mm) is A+B 90 degrees. The opening angle B in this angular position will be hereinafter referred to as a neutral angle B0. In this preferred embodiment, the initial angle A is set to 25 degrees, and the neutral angle B0, accordingly, is 65 degrees.

On the other hand, letting K denote a spring constant of the torsion spring 10 and L2 denote a distance from the support shaft 5 to the elongated hole 20, a rotation moment M2 (which will be hereinafter referred to as a spring moment M2) due to the torsion spring 10 at the opening angle B of the upper body 3 is expressed as follows:

$$M2 = K \cdot (C-B) \cdot L2 \tag{2}$$

Figure 3:
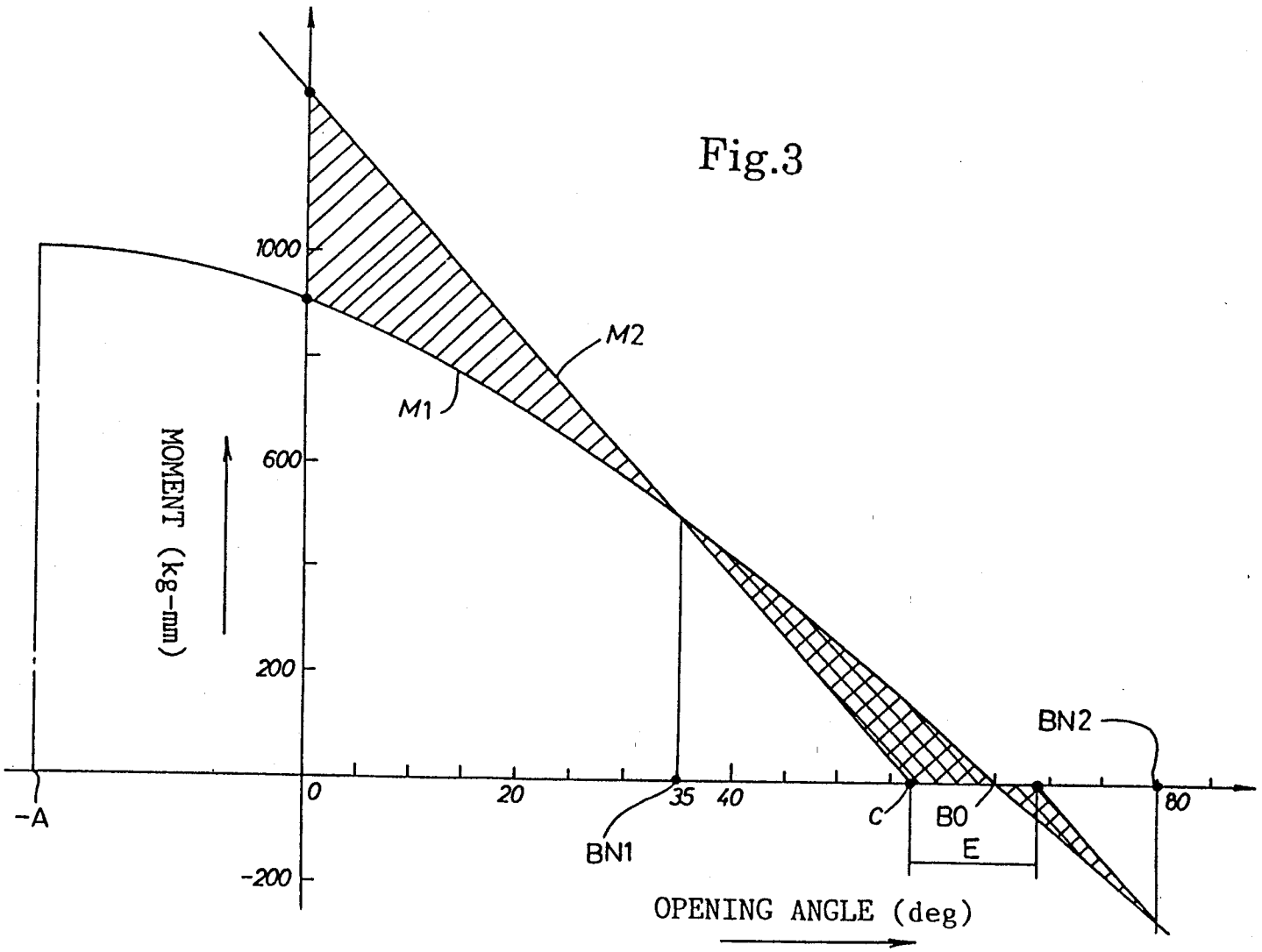
FIG. 3 is a graph showing a relationship between the opening angle of the upper body and the moments due to the weight of the upper body and the elastic constant of the elastic member.

The relationship between the body moment M1 expressed in equation (1) and the spring moment M2 expressed in equation (2) in relation to the opening angle B is shown in FIG. 3.

In this preferred embodiment, the torsion spring 10 is designed so as to satisfy the relationship $C<B0$ between the natural angle C and the neutral angle B0, and also satisfy the relationship of $M2>M1$ when the opening angle B is 0 deg.

As apparent from FIG. 3 illustrating the above relationship, when the opening angle B is 0 deg, the spring moment M2 is considerably larger than the body moment M1. Although the directions of the moments M1 and M2 are actually opposite to each other, the graph shows the same direction for the purpose of easy understanding.

When the opening angle B increases to reach 35 degrees, both the moments M1 and M2 come to a balance. The opening angle B at this time will be hereinafter referred to as a first balance angle BN1.

The first balance angle BN1 is required to satisfy the condition of 0 deg<BN1<B0. This condition is a necessary condition for automatically rotating the upper body 3 up to the first balance angle BN1 and automatically stopping the upper body 3 at the first balance angle BN1. The above-mentioned relationship between both the moments M1 and M2 and the first balance angle BN1 can be simply set according to the relationship between the spring constant K, the natural angle C and the distance L2 and the self-weight W and the distance L1.

Accordingly, when the locked condition of the upper body 3, maintained by the locking member 21, is released, the upper body 3 starts to be naturally rotated in the opening direction. In an initial stage of the rotation, the upper body 3 is rapidly rotated because the spring moment M2 is considerably larger than the body moment M1. Thereafter, the opening motion of the upper body 3 slows because the difference between the moments M1 and M2 is gradually reduced till the first balance angle BN1 is reached. When the opening angle B becomes the first balance angle BN1, the moments M1 and M2 are in balance or equal, thus stopping the upper body 3 (see a one-dot chain line in FIG. 2). Under such a stopped condition of the upper body 3, at the first balance angle BN1, an operator can exchange a printing unit 25 removably mounted in the upper body 3 or eliminate a paper jam in a paper feed section formed at a right portion of the laser printer as viewed in FIG. 2.

The printing unit 25 includes a photosensitive drum 25A and the paper feed section comprises a paper cassette 26 and a pick-up roller 27. Papers 28 are taken out one by one from the paper cassette 26 by the pick up roller 27 and fed to a paper feeding passage 29.

In the laser printer according to this preferred embodiment, a high-temperature section such as a thermal fixing section is located in the vicinity of the support shaft 5. The high-temperature section comprises a thermal fixing roller 30. The thermal fixing roller 30 has a heater 32 therein.

Accordingly, since eliminating a paper jam tends to occur in the paper feed section, the high-temperature section is not greatly exposed since the upper body 3 is stopped at the first balance angle BN1 above the lower body. Therefore, it is possible to prevent the operator from erroneously contacting the high-temperature section while eliminating the paper jam, thus ensuring the safety of the operator.

As described above, the stopping of the upper body 3 at the first balance angle BN1 is not attained by use of a stopper. Accordingly, the operator can easily further rotate the upper body 3 in the opening direction, from the first balance angle BN1, by slightly moving the upper body 3 in the opening direction. Until the opening angle B becomes equal to the natural angle C, the upper straight portion 17 of the torsion spring 10 is kept in contact with the rear edge 20A of the elongated hole 20. When the upper body 3 is further rotated beyond the natural angle C, the upper straight portion 17 of the torsion spring 10 is relatively moved in the elongated hole 20 from the rear edge 20A to the front edge 20B. The amount of movement of the upper straight portion 17 in the elongated hole 20 corresponds to an angular range E (which will be hereinafter referred to as a free angle E) shown in FIG. 3. In the range of the free angle E, the spring moment M2 is 0 kg-mm. The free angle E can be simply set by setting a length of the elongated hole 20. However, in doing so it is necessary to satisfy the relationship C+E>B0.

On the other hand, when the opening angle B becomes the neutral angle B0, the body moment M1 becomes 0 kg-mm. Thereafter, when the opening angle B exceeds the neutral angle B0, the upper body 3 generates a movement M1 in the opening direction. Thus, the upper body 3 starts to be rotated in the opening direction by its own weight just after being rotated beyond the neutral angle B0.

When the opening angle B exceeds the angle C+E, the upper straight portion 17 of the torsion spring 20 comes into contact with the front edge 20B of the elongated hole 20. Thereafter, the torsion spring 20 generates a spring moment M2 in a closing direction of the upper body 3 opposite to the direction of the body moment M1 generated after the neutral angle B0. The spring moment M2 at this time is expressed as follows:

$$M2=K\cdot(C-B+E)\cdot L2 \quad (3)$$

where B>B0.

As expressed in the equation (3), the value of the spring moment M2 generated in the closing direction of the upper body 3 increases linearly in relation to the opening angle B. In contrast, the rate of increase in the body moment M1 gradually decreases with an increase in the opening angle B. Accordingly, the difference in value between both the moments M1 and M2 gradually decreases to zero. The opening angle B at this time will be referred to as a second balance angle BN2. That is, both the moments M1 and M2 come to a balance at the second angle BN2, thus gently stopping the upper body 3. In this preferred embodiment, the second balance angle BN2 is set to 80 degrees and the free angle E is adjusted in relation thereto.

A stopped condition of the upper body 3 at the second balance angle BN2 is shown by a three-dot chain line in FIG. 2. As apparent from FIG. 2, the upper surface of the lower body 1 is largely exposed under this stopped condition to an extent that the portion in the vicinity of the support shaft 5 is exposed. Accordingly, the maintenance, inspection and exchange of parts located in the portion in the vicinity of the support shaft can be conveniently carried out.

As mentioned above, according to this preferred embodiment, the opening angles BN1 and BN2 for the two stops can be obtained without any troublesome effort or additional actions. At the appropriate one of these opening angles BN1 and BN2 , the maintenance and inspection of the equipment, the exchange of parts, and the elimination of a paper jam can be carried out safely, easily and smoothly.

Further, as the upper body 3 is stopped at each of the opening angles BN1 and BN2 by the balancing of the moments M1 and M2, it is possible to avoid the impact caused by the contact between the upper body and a stopper as used in the prior art. Accordingly, damage to the printer due to the contact is avoided.

Figure 4:
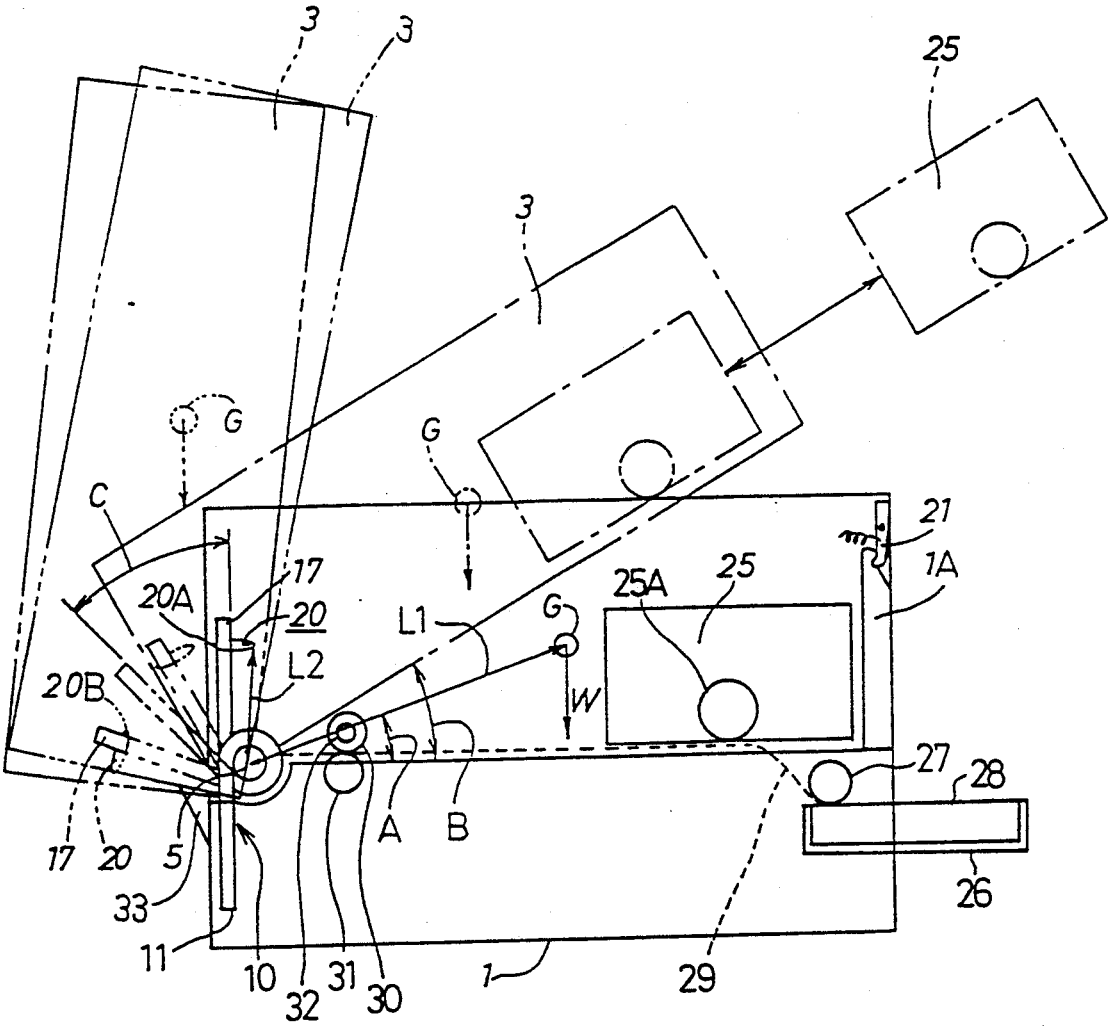
FIG. 4 is a schematic side illustration of the invention showing the use of a stopper.

For stopping the upper body 3 at the second stop point, a stop angle of the upper body 3 that is less than balance angle BN2 may be set by using a stopper 33 (FIG. 4). For example, if the relationship between the moments M1 and M2 as shown in FIG. 3 is satisfied, such a stopper may be mounted to set the stop angle at 75 degrees which is smaller than the second balance angle BN2=80 degrees.

In this modification, the spring moment M2 in the closing direction of the upper body 3 is generated by the torsion spring 20 until the opening angle B reaches 75 deg after exceeding the angle C+E. However, the rotating speed of the upper body 3 toward the stopper is suppressed thereby reducing the contact with the stopper. Thus, the impact is suppressed as compared to the prior art.

While the invention has been described with reference to a specific embodiment, the description is illustrative and is not to be construed as limiting the scope of the invention. Various modifications and changes may be carried out without departing from the scope of the invention.

For instance, a torsion bar may be substituted for the torsion spring. Further, a compression spring may be substituted for the torsion spring. In such a case, one end of the compression spring is fixed to the lower body and the other end is connected through a chain to the upper body. With this construction, when the rotating angle of the upper body is small, the compression spring serves as a compression spring. When the chain is in an unstretched condition, no force is exerted by the compression spring. When the chain is stretched however, the compression spring serves as a tension spring.

Alternatively, a rubber string may be substituted for the above chain. In this case, until the rotating angle reaches a first predetermined angle, the compression spring exerts an operating force in the opening direction of the upper body. After the rotating angle exceeds a second predetermined angle, the rubber string exerts an operating force in the closing direction of the upper body.

In addition, as stated at the beginning of this disclosure, the present invention is not limited to application to a laser printer but can be widely applied to various pieces of electronic equipment to include copying machines.

What is claimed is:

1. An opening/closing mechanism for a container for holding a piece of electronic equipment, comprising:
- a container body;
- a lower body for constituting a lower portion of said container body;
- an upper body for said container body for normally covering an upper surface of said lower body and being rotatable about one end thereof in a direction where said upper surface of said lower body is exposed;
- a holding member for holding said upper body at a position where said upper surface of said lower body is covered by said upper body; and
- an elastic member normally contacting said upper body for biasing said upper body in an opening direction for exposing said upper surface by exerting an elastic energy of itself when said upper body is released from said holding member, wherein an elastic constant of said elastic member is so set as to balance a closing force in a closing direction due to a weight of said upper body exerted in the closing direction thereof when said upper body is rotated up to a first predetermined angle, said weight being exerted at a center of gravity of said upper body, and said elastic member provides a reverse biasing means for accumulating an elastic energy thereof in a direction opposite to the opening direction of said upper body when a rotating angle of said upper body exceeds a first predetermined angle and reaches a second predetermined angle where said weight of said upper body, exerted at said center of gravity of said upper body, generates a force in said opening direction that is in balance with elastic energy of said elastic member.

2. An opening/closing mechanism for a container for a piece of equipment, said opening/closing mechanism comprising:
- a container body having an upper body rotatably mounted to a lower body;
- a mounting means for rotatably mounting said upper body;
- a support member in said lower body for supporting said mounting means;
- a locking mechanism for locking said upper body to said lower body at a side away from said rotating means;
- an opening force generating means attached to said rotating means for providing an opening force in an opening direction when said locking mechanism is released, said opening force generating means opposing a force exerted at a center of gravity of said upper body by a weight of said upper body; and
- a closing force generating means attached to said rotating means for exerting a closing force opposite to the opening direction when the force exerted at the center of gravity of said upper body becomes an opening force, wherein said opening force generating means and said closing force generating means are a single element.

3. An opening/closing mechanism as claimed in claim 2, further comprising:
- a first stop position where the opening force of said opening force generating means and a closing force exerted at said center of gravity of said upper body are balanced; and
- a second stop position.

4. An opening/closing mechanism as claimed in claim 3, wherein said second stop position is at a position where the closing force exerted by said closing force generating means and the opening force exerted at said center of gravity of said upper body are balanced.

5. An opening/closing mechanism as claimed in claim 3, further comprising a stop means attached to said lower body for engaging said upper body, said stop means stopping said upper body from opening further at a position where a difference in the closing force exerted by said closing force generating means and the opening force exerted at said center of gravity of said upper body is small, wherein said position is said second stop position.

6. An opening/closing mechanism as claimed in claim 3, wherein the single element is a torsion spring.

7. An opening/closing mechanism as claimed in claim 6, wherein one end of said torsion spring is fixedly mounted to said lower body and an opposite end of said torsion spring is retained in an elongated slot of a mount attached to said upper body.

8. An opening/closing mechanism as claimed in claim 7, wherein said opposite end of said torsion spring contacts a first end of said elongated slot during opening of said upper body when the opening force is exerted an when upon further opening said opposite end of said torsion spring contacts a second end of said elongated slot the closing force is exerted.

9. An opening/closing mechanism as claimed in claim 8, wherein said torsion spring exerts no force when said opposite end is not in contact with either of said first and second ends of said elongated slot.

* * * * *